United States Patent [19]

Higgins et al.

[11] Patent Number: 4,931,835

[45] Date of Patent: Jun. 5, 1990

[54] APPARATUS FOR MONITORING DEVELOPER MIXTURE

[75] Inventors: Joanne M. Higgins; Michael Mosehauer, both of Rochester, N.Y.

[73] Assignee: Eastman Kodak Company, Rochester, N.Y.

[21] Appl. No.: 270,586

[22] Filed: Nov. 14, 1988

[51] Int. Cl.[5] ..... G03G 21/00

[52] U.S. Cl. ..... 355/203; 118/689; 355/246

[58] Field of Search ..... 355/246, 208, 203; 118/689, 690

[56] References Cited

U.S. PATENT DOCUMENTS

| | | | |
|---|---|---|---|
| 3,273,392 | 9/1966 | Olsen | 73/295 |
| 3,527,651 | 9/1970 | Shelffo et al. | 118/690 X |
| 4,343,548 | 8/1982 | Bares et al. | 355/246 |
| 4,364,659 | 12/1982 | Noda | 355/14 |
| 4,513,616 | 4/1985 | Bezard | 73/295 |
| 4,538,897 | 9/1985 | Osaka et al. | 118/689 X |
| 4,611,900 | 9/1986 | Folkins | 355/3 DD |
| 4,711,551 | 12/1987 | Fujio | 355/3 DD |

FOREIGN PATENT DOCUMENTS

| | | | |
|---|---|---|---|
| 0127776 | 6/1987 | Japan | 355/208 |

*Primary Examiner*—A. T. Grimley
*Assistant Examiner*—Robert Beatty
*Attorney, Agent, or Firm*—Milton S. Sales

[57] ABSTRACT

An electrostatographic reproduction machine includes a toner concentration monitor having a resistive element through which electrical current is passed. The resistive element is heated by the electrical current. In a steady state mode, the resistive element transfers heat to its surroundings and attains a steady state temperature dependent upon the heat transfer characteristics of the surroundings. The toner concentration is detected by measuring the power into the resistive element. The heat transfer characteristics are determined by the thermal conductivity and the flow rate of the developer mixture.

30 Claims, 4 Drawing Sheets

APPARATUS FOR MONITORING DEVELOPER MIXTURE

CROSS REFERENCE TO RELATED APPLICATION

This application is related to commonly assigned U.S. patent application Ser. No. 214,967, filed in the name of K. A. Arnold et al. on July 5, 1988.

1. Technical Field

This invention relates generally to toner concentration monitors for electrostatographic machines.

2. Background Art

Electrostatographic machines generally use a two-component developer mixture comprised of a toner powder and a magnetized, or magnetizable, carrier material. During the use of the machine, toner powder has to be replenished to compensate for its consumption during image development. Various automatic toner replenishment systems are known wherein a signal from a toner concentration monitor controls replenishment. Conventional toner concentration monitors may take several forms, including optical sensors, capacitance sensors, resistance sensors, inductance sensors, magnetic sensors, etc.

Optical sensors are subject to scumming and dust contamination, misalignment, and errors due to inconsistent developer flow rates. Capacitance and inductance sensors are temperature and flow rate sensitive, require accurate spacing, and have a low signal to noise ratio. Magnetic sensors are subject to packing density and flow property changes, variations in degree of contact with the mixture, and temperature changes.

DISCLOSURE OF INVENTION

An object of the present invention is to provide a toner monitor with an innate ability to compensate readings for temperature.

As an important feature of the present invention, the concentration of toner in a developer mixture is monitored by passing an electrical current through a resistive element and measuring the heat loss from the element as a function of toner concentration.

According to a feature of the present invention, an electrostatographic reproduction machine includes an improved toner concentration monitor comprising a resistive element which is contacted by a toner composition. An electrical current is passed through the resistive element such that the resistive element is heated and transfers heat to its surroundings dependent upon the heat transfer characteristics of its surroundings. The electrical power to the resistive element to maintain a constant temperature, current or voltage is a function of toner concentration.

In a preferred embodiment of the present invention, the toner concentration monitor's resistive element is a hot wire. In another embodiment, the resistive element is a thermistor. The means for passing electrical current through the resistive element may be a constant current or a constant voltage source.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
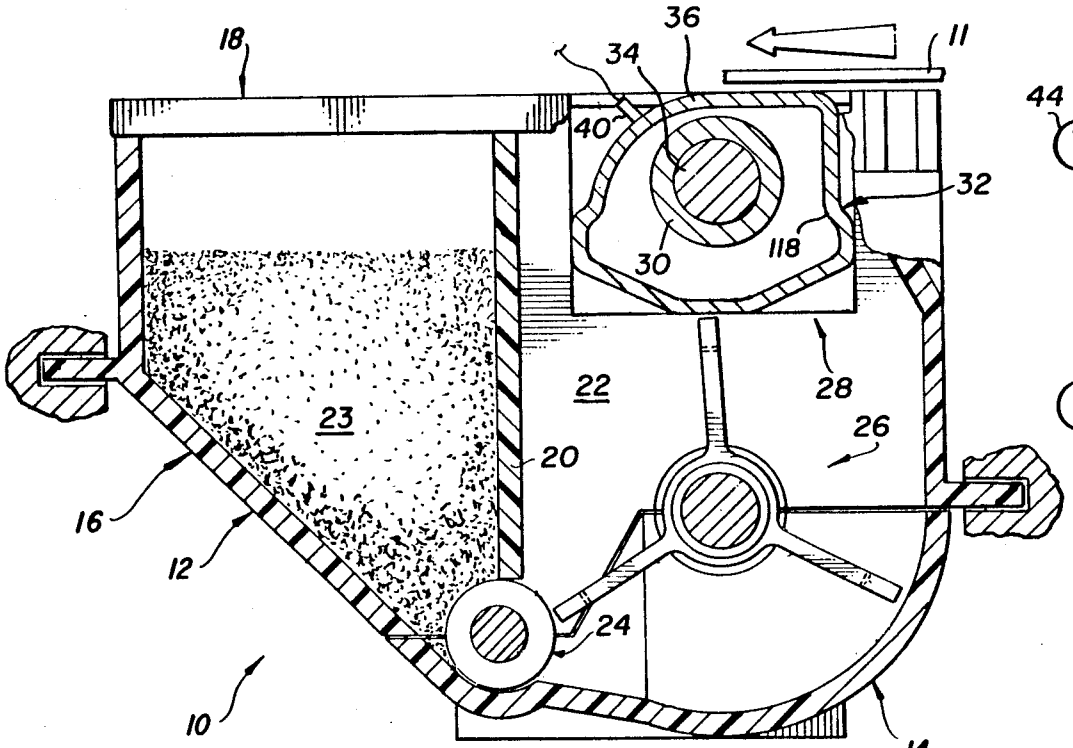
FIG. 1 is a transverse cross-sectional view of a development station and a portion of an electrostatographic machine.

Referring to FIG. 1 of the drawings, a development station is generally designated 10. It is used to develop latent electrostatic images on a surface of a receiver member 11 (such as a photoconductor) of a copier or printer as the receiver member is driven past the development station in the direction indicated by the arrow. The illustrated development station is similar to that which is disclosed in commonly assigned U.S. patent application Ser. No. 214,967, filed in the name of K. A. Arnold et al. on July 5, 1988, but could take any of several forms well known in the art.

Development station 10 comprises an elongate housing 12 that is assembled from three housing parts 14, 16, and 18. Center housing part 16 has a vertically oriented wall 20 that extends the full length of the housing. The lower edge of wall 20 is spaced from the inner surface of bottom part 14 such that wall 20 divides the housing into two separate chambers 22 and 23 positioned in side-by-side relationship with the space beneath wall 20 providing access between the chambers. Chamber 22 is adapted to receive a two-component developer mixture comprising carrier particles and toner powder that are to be furnished to latent images on receiver member 11. Chamber 23, on the other hand, holds a supply of fresh toner powder. Toner powder is periodically metered from chamber 23 to chamber 22 by a toner dispensing roller 24 to maintain the desired toner concentration in the developer mixture as determined by a toner concentration monitor described later herein.

The carrier particles and toner powder in chamber 22 are mixed together by a mixing wheel 26, which lifts some of the mixture to a developer applicator generally designated 28. Applicator 28 comprises a magnetic brush having a rotatable magnetic roller 30 positioned within a stationary shell 32. Magnetic roller 30 can be of a conventional construction comprising a plurality of magnetic poles that extend longitudinally along a shaft 34 with alternate poles in a circumferential direction comprising north and south poles. The mixture is magnetically held to the applicator so that rotation of the magnetic roller in a clockwise direction as viewed in FIG. 1 feeds developer mixture upwardly and then along wall 36 so that toner powder can contact receiver member 11 as the member moves past the development station for developing the latent images. Toner powder which does not adhere to the receiver returns with the carrier to chamber 22 along the back side of shell 32.

Changes in the concentration of toner particles in the developer mixture are sensed by a monitor including a probe 40, to be explained in detail below. The output of the toner concentration monitor drives a toner replenishment motor, not shown, which turns toner dispensing roller 24 to maintain the desired toner concentration in the developer mixture. As an example, the output of the toner concentration monitor may be compared with a reference signal representing a desired toner concentration level, and any difference between the monitor's output and the reference signal may be fed to a controller; see commonly assigned U.S. Pat. No. 4,607,944, which issued to A. J. Rushing on Aug. 26, 1986.

Toner concentration monitor probe 40 consists of a resistive element such as a resistive wire (also referred to a "hot wire"). The wire is preferably covered by a thin, electrically insulating coating to avoid conducting current to the carrier particles and to endure abrasive scrubbing by the developer material. However, it has been discovered that electrical contact with the carrier particles is poor, so shorting may not be a problem in actual applications. Alternatively, the resistive element can be a thermistor device, which is an electronic device that makes use of the change of resistivity of a semiconductor with change in temperature.

Figure 2:
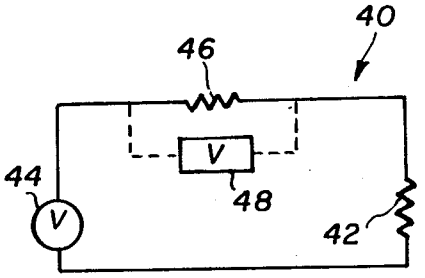
FIG. 2 is a schematic view of a constant voltage toner monitor probe in accordance with one embodiment of the invention.

Referring to FIG. 2, the resistive element of probe 40 is referred to by reference numeral 42, and is connected to a constant voltage source 44 so that the element is heated by passing current through it. In a steady state mode, the resistive element transfers heat to its surroundings and attains a steady state temperature dependent upon the heat transfer characteristics of the surroundings. It is a characteristic of a thermistor that the electrical resistance "R⇄ of the element changes as its temperature increases. Since the voltage "V⇄ is the current "I" multiplied by the resistance (V=IR), the current requirement changes to maintain a constant voltage. If the thermistor is such as to exhibit a decrease in resistance with increasing temperature, application of additional current to maintain a constant voltage would cause further heating, a further decrease in resistance, and continued increase in current. This potential instability could result in excessive heating and element destruction without a current limiting resistor 46 in series with resistive element 42.

The response of the resistive element is monitored by a voltmeter 48 across current limiting resistor 46. This is preferred to directly monitoring the voltage of resistive element 42 since the latter voltage varies inversely with temperature, and since more sensitivity is obtained by monitoring the limiting resistor.

Operating in the constant voltage mode disclosed above is convenient because constant voltage power supplies are readily available in copiers and printers. However, with such power supplies the current is limited to very small values. This small power input produces a very slow rate of heating and long and unsteady transient effects.

Figure 3:
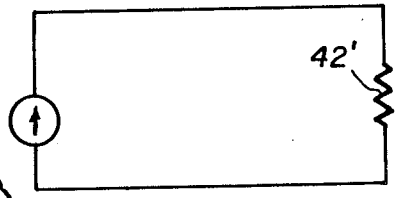
FIG. 3 is a schematic view of a constant current toner monitor probe in accordance with one embodiment of the invention.

Accordingly, another embodiment of the present invention comprises constant current operation, as shown in FIG. 3. A current step is input for heating to begin. The resistance decreases as the temperature increases, and since the current is equal to the voltage divided by the resistance (I=V/R), the voltage decreases to maintain constant current. This causes cooling, which increases resistance. The voltage responds by increasing slightly, causing a small amount of additional heating and a subsequent small decrease in resistance until equilibrium is reached. This is an inherently stable operating mode, needing no limiting circuit elements. While the circuitry for constant current operation may be slightly more complex than for constant voltage operation, stability and faster response may make this a desirable option.

The carrier particles of the developer mixtures are usually iron, having a thermal conductivity on the order of 30 BTU/hr-ft-°F. In contrast, that of the toner polymer material is on the order of 0.1 BTU/hr-ft-°F. Early in the development of the present invention, it was thought the the probe could be suspended in the developer sump of chamber 22 and would attain different temperatures at different toner concentrations since the thermal conductivity of the mixture would change inversely with the toner concentration. However, when tested, there was substantially no signal difference with different toner concentrations. This indicated that the thermal contact between the probe and the solid particles was poor. The mixture packing densities at all toner concentrations are low compared to the densities of the solid constituents, and air pockets were large compared to the particle sizes. This poor thermal contact makes the conduction mode of heat transfer ineffective.

However, more favorable results are expected with liquid-developer mixtures, powder mixtures which pack without large air spaces, and carrier material having very high thermal conductivity. Accordingly, the present invention contemplates an embodiment wherein the probe is used to measure toner concentration by changes in thermal conductivity of the development mixture.

In operation, as the developer mixture flows around stationary shell 32, the flow velocity changes as the toner concentration of the mixture changes. By at least partially submerging the resistive element in the magnetic brush nap, the toner concentration can be indirectly determined by using the probe to measure the flow velocity of the mixture. It has been empirically determined that with the probe mounted on the toning shell just past the toning zone in the region of maximum magnetic flux and operated in a 12 milliamp constant current mode, a 0.070 inch diameter probe produced good results in a 0.035 inch brush nap. In fact, the sensitivity was about 0.224 volts per percent toner concentration; an excellent response compared to other known technology.

It is believed that the flow velocity of the developer mixture changes as the toner concentration changes because different proportions of magnetic material are present. The high magnetic flux location of the probe provides the maximum manifestation of this behavior, and is therefore most suitable for maximum sensor response. When the resistive element transfers heat to the surrounding developer, it attains a steady state temperature dependent upon the flow velocity of the developer mixture.

Successful operation has been obtained for probe temperatures up to and including about 130° F. in a flowing developer mixture. This is high enough above any reasonable ambient environment to provide a distinct signal. Note that the probe temperature is above the fusing temperature of the toner. However, there is sufficient forced convection cooling from the flowing mixture to avoid toner fusing. A short heating duration, say less than 15 seconds, also assures success in this respect.

Yet another mode of operation of the present invention makes use of the large signal change produced by the probe when immersed in either toner powder or developer mixture compared to when surrounded by free air. Natural convection is the dominant mode of heat transfer in air, and is a less effective heat transfer mechanism than the conduction which takes place when the probe is submerged in toner powder or development mixture. Thus the probe becomes hotter when suspended in air than when submerged.

Figure 4:
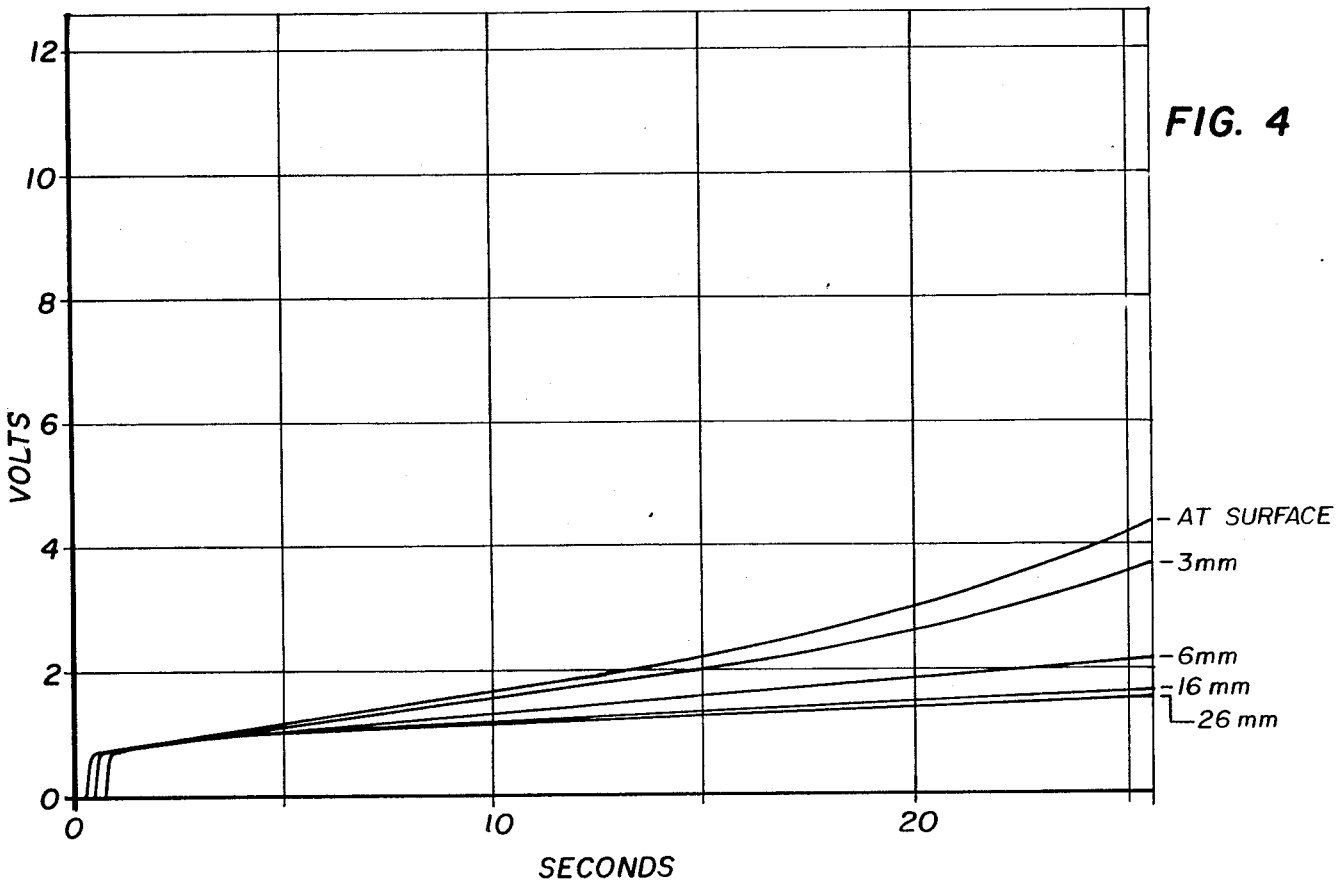
FIG. 4 is a chart comparing the probe output at various depths in toner.

FIG. 4 shows voltage traces recorded as the probe was placed at different vertical positions in a container of toner powder, and would be representative of an embodiment wherein the probe was placed in chamber 22 or chamber 23 of FIG. 1 and used to measure the height of toner or developer above the probe. Operation here was in the above-described constant voltage mode, with the source approximately equal to 20 volts. The voltage across current limiting resistor 46 (FIG. 2) was monitored, so the reading was directly proportional to the probe temperature. In the example, the toner powder depth was 30 mm, and five readings were recorded, one each at probe depths of 26 mm, 16 mm, 6 mm, 3 mm, and 0 mm (surface).

At the two deepest positions (26 mm and 16 mm), the probe temperature traced the same history. The 6 mm and 3 mm positions indicated that the probe was getting hotter as it approached the surface. It is believed that this occurs because there was less toner powder above the probe and the packing density may have been less as well; both effects tending to conduct less heat from the probe. The probe was hottest at the surface of the toner.

Figure 5:
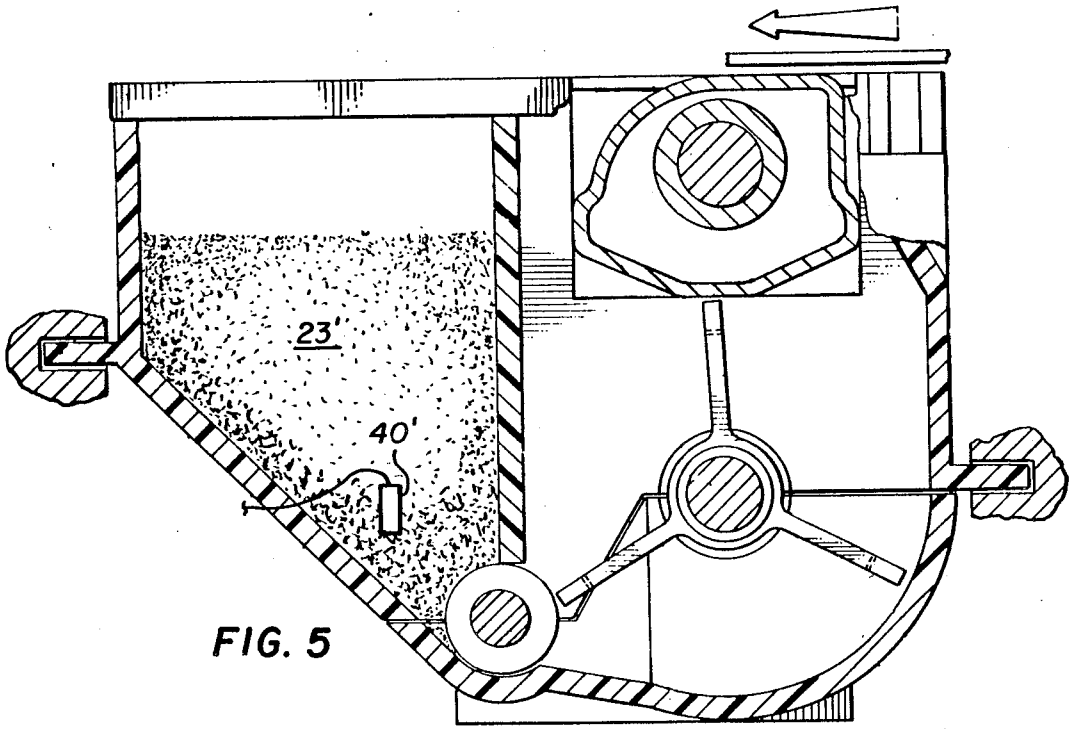
FIG. 5 is a transverse cross-sectional view of a development station and a portion of an electrostatographic machine.

FIG. 4 demonstrates the very successful application of the present invention as a toner powder level detector. This property has been used advantageously in the embodiment of FIG. 5, wherein a probe has been placed in the toner supply of chamber 23'. As toner powder is used, the level of the powder in chamber 23' falls. The temperature of probe 40' increases, providing an indication of the amount of toner powder remaining in the chamber.

Figure 6:
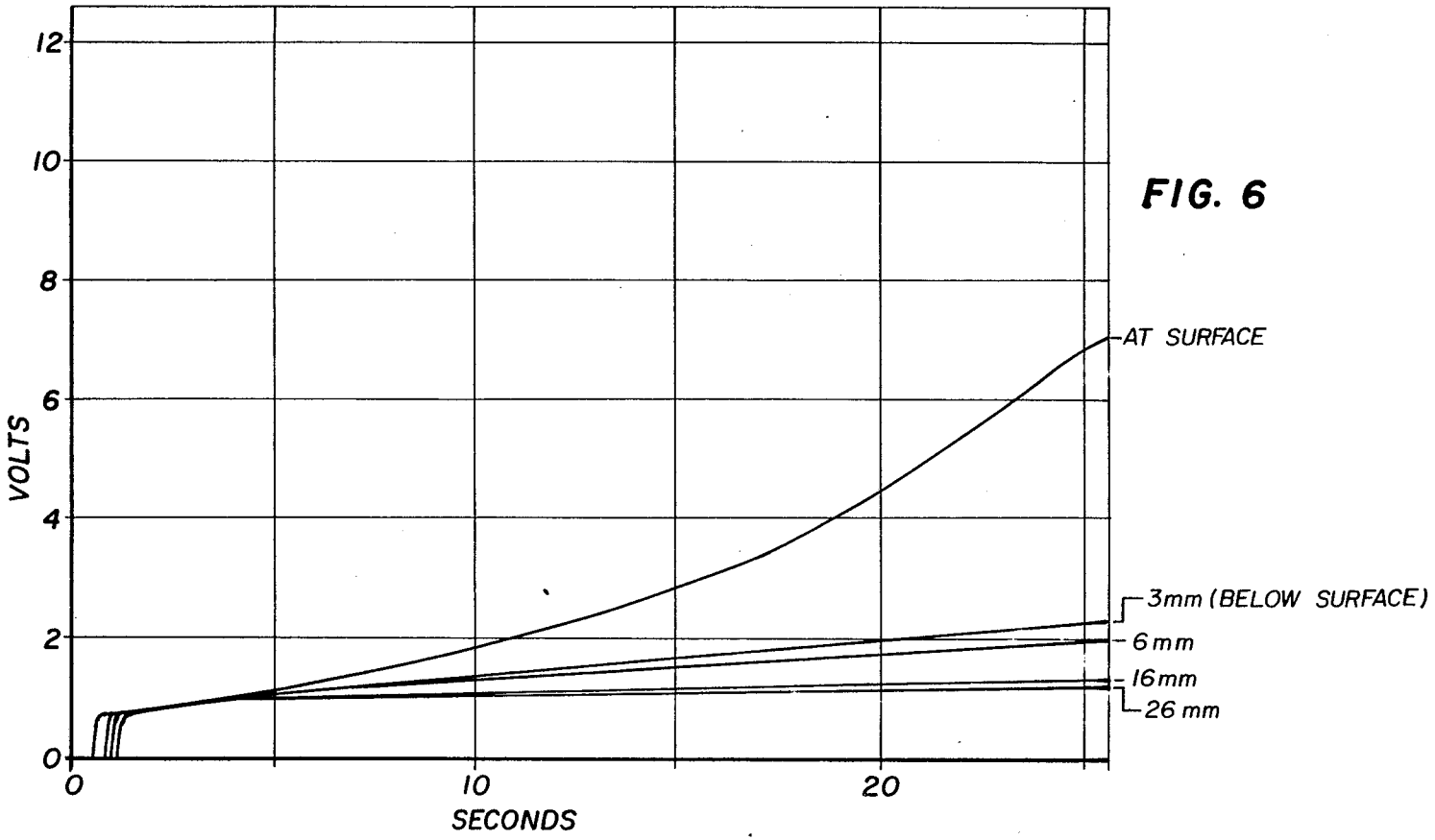
FIG. 6 is a chart comparing the probe output at various depths in developer mixture.

FIG. 6 shows the probe response when the probe was placed at different vertical positions in a container of 12% toner concentration developer mixture. It was noted that the operation of the probe was even more effective than in a pure toner powder material. This property can be used advantageously were a probe placed in developer mixture chamber 22 of FIG. 1. As the concentration of the developer mixture is depleted, the level of the mixture in chamber 22 falls. The temperature of the probe increases, providing an indication of the concentration of toner powder remaining in the mixture. The flat, large surface area configuration of chamber 22 tends to minimize the change in mixture height with changes in concentration. If the sump geometry were columnar instead of flat, the volume change would be amplified and more readily resolvable.

For use in a quiescent sump, such as the uses referred to above for level detection and conductivity detection, no forced convection cooling takes place. To avoid fusing the toner, the probe operating temperature should be cooler than the fusing temperature by applying a smaller heating current and/or shorter "on" time. Optimum values can easily be determined empirically.

Since the developer mixture temperature has an impact on the heat transfer between the mixture and the probe, the probe response must be calibrated for the range of operating temperatures encountered in the field. This can reasonably be expected to be from 60° F. to about 100° F. For each mixture temperature, a probe response curve with toner concentration is determined and stored in a microprocessor.

In operation, the probe is first used to determine the mixture temperature by reading its resistance in the mixture. The can be done by passing a small non-heating current through it, reading the voltage, and computing the resistance. The mixture temperature is then determined from a calibration curve stored in memory. This information is used to choose from memory the appropriate response curve to determine toner concentration at that mixture temperature.

The measurement is then completed by applying the larger heating current step to the element for perhaps ten to fifteen seconds to assure that a steady state value has been attained. The voltage across the sensor is recorded, and the chosen response curve is used, with this voltage, to read the toner concentration.

The invention has been described in detail with particular reference to preferred embodiments thereof, but it will be understood that variations and modifications can be effected within the spirit and scope of the invention. For example, the steady state mode of operation has been explained. However, one needn't wait until a steady state temperature is reached if the rate of change of temperature is repeatable.

What is claimed is:

1. In an electrostatographic reproduction machine comprising means for contacting an electrostatic image-bearing surface with a developer mixture of toner and carrier particles to apply toner to such surface to render the electrostatic image visible, an improved toner concentration monitor comprising:

a resistive element in heat transfer contact with a toner composition;

means for passing electrical current through said resistive element whereby said resistive element is heated and transfers heat to its surroundings at a rate dependent upon the heat transfer characteristics of said surroundings; and means for measuring the electrical power into said resistive element, whereby said power is a function of toner concentration.

2. A toner concentration monitor as set forth in claim 1 wherein said resistive element is a hot wire.

3. A toner concentration monitor as set forth in claim 2 wherein said hot wire is coated with insulating material.

4. A toner concentration monitor as set forth in claim 1 wherein said resistive element is a thermistor.

5. A toner concentration monitor as set forth in claim 1 wherein said means for passing electrical current through said resistive element comprises a constant current source electrically connected to said resistive element.

6. A toner concentration monitor as set forth in claim 1 wherein said means for passing electrical current through said resistive element comprises a constant voltage source electrically connected to said resistive element.

7. In an electrostatographic reproduction machine comprising means for contacting an electrostatic image-bearing surface with a developer mixture of toner and carrier particles to apply toner to such surface to render the electrostatic image visible, an improved toner concentration monitor comprising:

a resistive element which exhibits a property wherein its electrical resistance is characteristic of the temperature of said resistive element;

means for contacting said resistive element by a toner composition; and means for passing electrical current through said resistive element whereby said resistive element is heated and transfers heat to its surroundings at a rate dependent upon the heat transfer characteristics of said surroundings; and means for measuring the electrical power into said resistive element, whereby said power is a function of toner concentration.

8. A toner concentration monitor as set forth in claim 7 wherein said resistive element is a thermistor.

9. A toner concentration monitor as set forth in claim 7 wherein said means for passing electrical current through said resistive element comprises a constant current source electrically connected to said resistive element.

10. A toner concentration monitor as set forth in claim 7 wherein said means for passing electrical current through said resistive element comprises a constant voltage source electrically connected to said resistive element.

11. A toner concentration monitor as set forth in claim 7 wherein said means for passing electrical current through said resistive element comprises:

a constant voltage source electrically connected to said resistive element; and a current limiting resistor in series with said constant voltage source and said resistive element.

12. A toner concentration monitor as set forth in claim 11 further comprising means for monitoring the voltage across said current limiting resistor.

13. In an electrostatographic reproduction machine comprising means for contacting an electrostatic image-bearing surface with a developer mixture of toner and carrier particles to apply toner to such surface to render the electrostatic image visible, an improved toner concentration monitor comprising:

a resistive element which exhibits a property wherein its electrical resistance increases inversely with temperature;

means for suspending said resistive element in a developer mixture of unknown toner concentration; and an electrical power source for passing electrical current through said resistive element whereby said resistive element is heated and transfers heat to the developer mixture at a rate dependent upon the toner concentration of the mixture; and means for measuring the electrical power into said resistive element, whereby said power is a function of toner concentration.

14. A toner concentration monitor as set forth in claim 13 further comprising means for determining the toner concentration of the developer mixture from the electrical power consumed by said power source to just replace the heat lost from said resistive element.

15. A toner concentration monitor as set forth in claim 13 further comprising means for maintaining said resistive element at a temperature less than the fusing temperature of the, toner.

16. In an electrostatographic reproduction machine comprising means for causing the nap of a magnetic brush to contact an electrostatic image-bearing surface with a developer mixture of toner and carrier particles to apply toner to such surface to render the electrostatic image visible, an improved toner concentration monitor comprising:

a resistive element in contact with the nap of the magnetic brush; and means for passing electrical current through said resistive element whereby said resistive element is heated and transfers heat to the developer mixture of the magnetic brush until it attains a steady state temperature dependent upon the flow rate of the developer mixture in the magnetic brush, whereupon the resistive heating of said resistive element is balanced by the heat transfer from said resistive element.

17. A toner concentration monitor as set forth in claim 16 wherein said resistive element is suspended at about the mid depth of the magnetic brush nap.

18. A toner concentration monitor as set forth in claim 16 wherein said resistive element is positioned in the region of approximate maximum flux of the magnetic brush.

19. A toner concentration monitor as set forth in claim 16 wherein said resistive element is heated to a temperature greater than the fusing temperature of the toner particles.

20. A toner concentration monitor as set forth in claim 16 wherein said resistive element is heated to approximately 130° F.

21. A toner concentration monitor as set forth in claim 16 wherein said resistive element is in a high magnetic flux region of the magnetic brush.

22. In an electrostatographic reproduction machine comprising means for causing the nap of a magnetic brush to contact an electrostatic image-bearing surFace with a developer mixture of toner and carrier particles to apply toner to such surface to render the electrostatic image visible, an improved toner concentration monitor comprising:

a resistive element which exhibits a property wherein its electrical resistance is characteristic of the temperature of said resistive element;

means for contacting said resistive element by the nap of the magnetic brush; and means for passing electrical current through said resistive element whereby said resistive element is heated and transfers heat to the developer mixture of the magnetic brush until it attains a steady state temperature dependent upon the flow rate of the developer mixture in the magnetic brush, whereupon the resistive heating of said resistive element is balanced by the heat transfer from said resistive element.

23. A toner concentration monitor as set forth in claim 22 wherein said resistive element is suspended at about the mid depth of the magnetic brush nap.

24. A toner concentration monitor as set forth in claim 22 wherein said resistive element is positioned in the region of approximate maximum magnetic flux of the magnetic brush.

25. A toner concentration monitor as set forth in claim 22 wherein said resistive element is heated to a temperature greater than the fusing temperature of the toner particles.

26. A toner concentration monitor as set forth in claim 22 wherein said resistive element is heated to approximately 130° F.

27. A toner concentration monitor as set forth in claim 22 wherein said resistive element is in a high magnetic flux region of the magnetic brush.

28. In an electrostatographic reproduction machine comprising means for contacting an electrostatic image-bearing surface with a developer mixture of toner and carrier particles to apply toner to such surface to render the electrostatic image visible, an improved toner monitor comprising:

a resistive element in heat transfer contact with a toner composition; and means for passing electrical current through said resistive element whereby said resistive element is heated and transfers heat to its surroundings until it attains a steady state temperature dependent upon the heat transfer characteristics of said surroundings, whereupon the resistive heating of said resistive element is balanced by the heat transfer from said resistive element.

29. In an electrostatographic reproduction machine comprising means for contacting an electrostatic image-bearing surface with a developer mixture of toner and carrier particles to apply toner to such surface to render the electrostatic image visible, an improved toner monitor comprising:

a resistive element which exhibits a property wherein its electrical resistance is characteristic of the temperature of said resistive element;

means for contacting said resistive element by a toner composition; and means for passing electrical current through said resistive element whereby said resistive element is heated and transfers heat to its surroundings until it attains a steady state temperature dependent upon the heat transfer characteristics of said surroundings, whereupon the resistive heating of said resistive element is balanced by the heat transfer from said resistive element.

30. In an electrostatographic reproduction machine comprising means for contacting an electrostatic image-bearing surface with a developer mixture of toner and carrier particles to apply toner to such surface to render the electrostatic image visible, an improved toner concentration monitor comprising:

a resistive element which exhibits a property wherein its electrical resistance increases inversely with temperature;

means for suspending said resistive element in a developer mixture of unknown toner concentration; and an electrical power source for passing electrical current through said resistive element whereby said resistive element is heated and transfers heat to the developer mixture until it attains a steady state temperature dependent upon the toner concentration of the mixture, whereupon the resistive heating of said resistive element is balanced by the heat transfer from said resistive element to the developer mixture.

* * * * *